US009278261B2

(12) United States Patent
Huang et al.

(10) Patent No.: US 9,278,261 B2
(45) Date of Patent: Mar. 8, 2016

(54) GOLF SYSTEM WITH WIRELESS COMMUNICATION FUNCTIONS

(71) Applicant: Jogtek Corp., Taipei (TW)

(72) Inventors: Wei-Chun Huang, Taipei (TW); Tsung-Hsing Hsieh, Taipei (TW)

(73) Assignee: JOGTEK CORP., Taipei (TW)

( * ) Notice: Subject to any disclaimer, the term of this patent is extended or adjusted under 35 U.S.C. 154(b) by 156 days.

(21) Appl. No.: 14/282,533

(22) Filed: May 20, 2014

(65) Prior Publication Data

US 2015/0335961 A1 Nov. 26, 2015

(51) Int. Cl.

| | |
|---|---|
| ***G08B 1/08*** | (2006.01) |
| ***A63B 53/00*** | (2015.01) |
| ***A63B 55/00*** | (2015.01) |
| ***G08B 25/10*** | (2006.01) |
| ***A63B 69/36*** | (2006.01) |
| ***G08B 13/14*** | (2006.01) |

(52) U.S. Cl.

CPC ..... *A63B 53/00* (2013.01); *A63B 55/00* (2013.01); *A63B 69/36* (2013.01); *A63B 69/3632* (2013.01); *G08B 13/1427* (2013.01); *G08B 25/10* (2013.01); *A63B 2055/001* (2013.01); *A63B 2225/54* (2013.01)

(58) Field of Classification Search

CPC ..... A63B 69/36; A63B 69/3632; A63B 2243/0029; A63B 2225/54; G08B 13/1427

USPC ..... 340/568.6, 10.1, 539.23

See application file for complete search history.

(56) References Cited

U.S. PATENT DOCUMENTS

| | | | | |
|---|---|---|---|---|
| 5,028,909 | A * | 7/1991 | Miller | 340/568.6 |
| 6,366,205 | B1 * | 4/2002 | Sutphen | 340/568.6 |
| 6,411,211 | B1 * | 6/2002 | Boley et al. | 340/568.6 |
| 7,205,894 | B1 * | 4/2007 | Savage | 340/568.6 |
| 2003/0132844 | A1 * | 7/2003 | Walker | 340/568.6 |

* cited by examiner

*Primary Examiner* — John A Tweel, Jr.

(74) *Attorney, Agent, or Firm* — Muncy, Geissler, Olds & Lowe, PLLC

(57) ABSTRACT

A golf system with wireless communication functions is applied to a handheld electric apparatus. The golf system includes at least a golf club apparatus and a golf bag apparatus. The golf club apparatus includes a golf club and a short distance communication identification tag. The short distance communication identification tag is attached to the golf club. The golf bag apparatus includes a golf bag and a wireless communication identification reader. The wireless communication identification reader is attached to the golf bag. The wireless communication identification reader is configured to identify the short distance communication identification tag wirelessly, and then inform the handheld electric apparatus wirelessly.

4 Claims, 2 Drawing Sheets

GOLF SYSTEM WITH WIRELESS COMMUNICATION FUNCTIONS

BACKGROUND OF THE INVENTION

1. Field of the Invention

The present invention relates to a golf system, and especially relates to a golf system with wireless communication functions.

2. Description of the Related Art

Bluetooth uses a radio technology called frequency-hopping spread spectrum. Bluetooth provides a secure way to connect wireless transmission devices and exchange information therebetween. Radio frequency identification (RFID) is a technology for retrieving data from radio frequency identification tags. Radio frequency identification tags can be read on a short distance from a radio frequency identification reader. Near field communication (NFC) is a high frequency wireless communication method applied in wireless transmission devices that are spaced from each other within about a distance of 10 cm. The near field communication technology is an extension of the radio frequency identification technology.

Bluetooth, RFID, and NFC are common wireless communication technologies. However, it is a pity that Bluetooth, RFID, and NFC is not applied to a conventional golf club or golf bag for identification.

SUMMARY OF THE INVENTION

In order to solve the above-mentioned problems, an object of the present invention is to provide a golf system with wireless communication functions.

In order to achieve the object of the present invention mentioned above, the golf system is applied to a handheld electric apparatus. The golf system includes at least a golf club apparatus and a golf bag apparatus. The golf club apparatus includes a golf club and a short distance communication identification tag. The short distance communication identification tag is attached to the golf club. The golf bag apparatus includes a golf bag and a wireless communication identification reader. The wireless communication identification reader is attached to the golf bag. The wireless communication identification reader is configured to identify the short distance communication identification tag wirelessly, and then inform the handheld electric apparatus wirelessly.

DETAILED DESCRIPTION OF THE INVENTION

Figure 1:
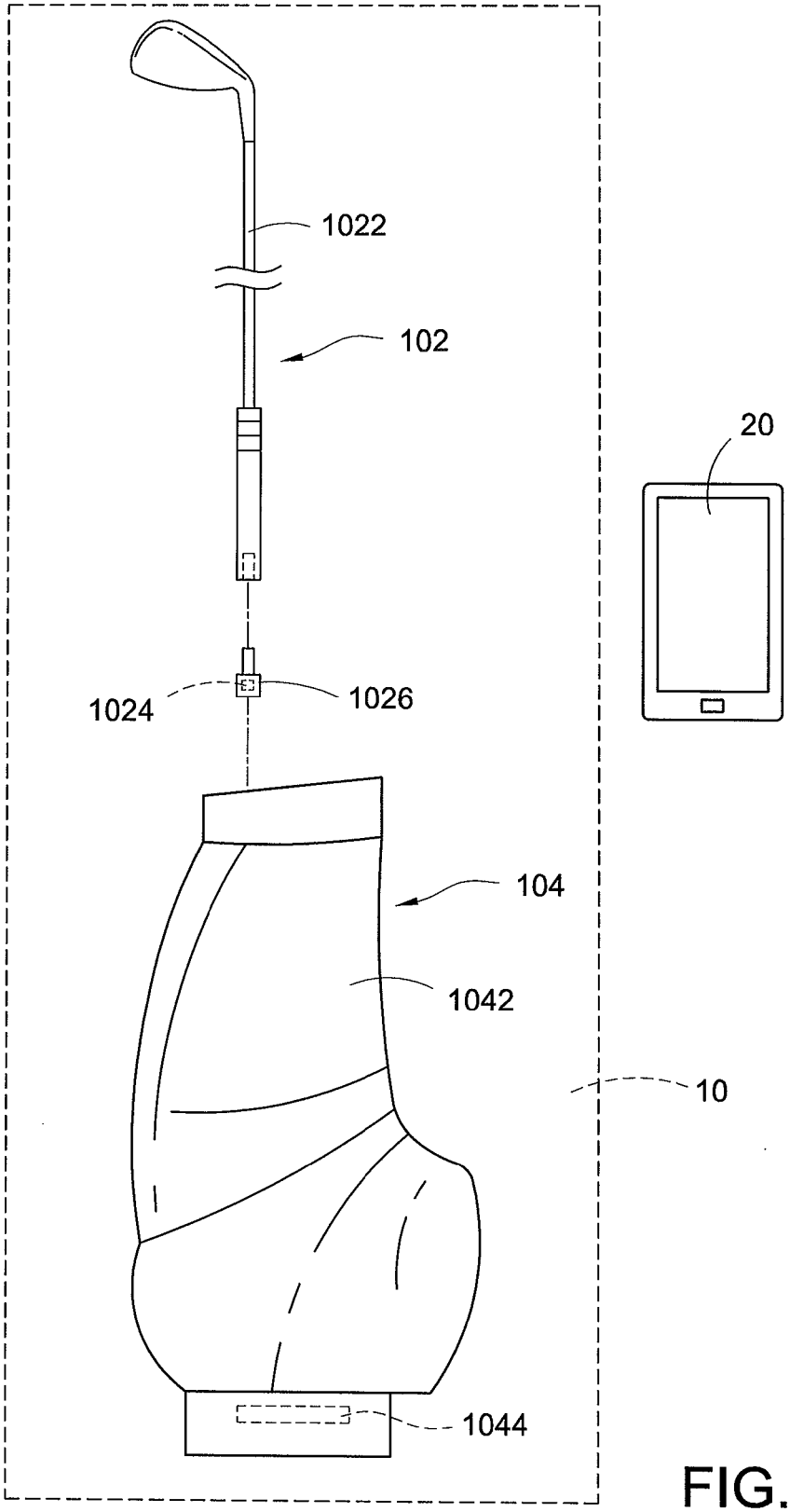
FIG. 1 shows a schematic diagram of the golf system with wireless communication functions of the present invention.

FIG. 1 shows a schematic diagram of the golf system with wireless communication functions of the present invention. A golf system 10 with wireless communication functions is applied to a handheld electric apparatus 20. The golf system 10 includes at least a golf club apparatus 102 and a golf bag apparatus 104.

The golf club apparatus 102 includes a golf club 1022 and a short distance communication identification tag 1024. The short distance communication identification tag 1024 is attached to the golf club 1022. The golf bag apparatus 104 includes a golf bag 1042 and a wireless communication identification reader 1044. The wireless communication identification reader 1044 is attached to the golf bag 1042.

The wireless communication identification reader 1044 is configured to identify the short distance communication identification tag 1024 wirelessly, and then inform the handheld electric apparatus 20 wirelessly. Therefore, a user can read the handheld electric apparatus 20 to know that whether the golf club apparatus 102 is put into the golf bag apparatus 104 or not.

Figure 2:
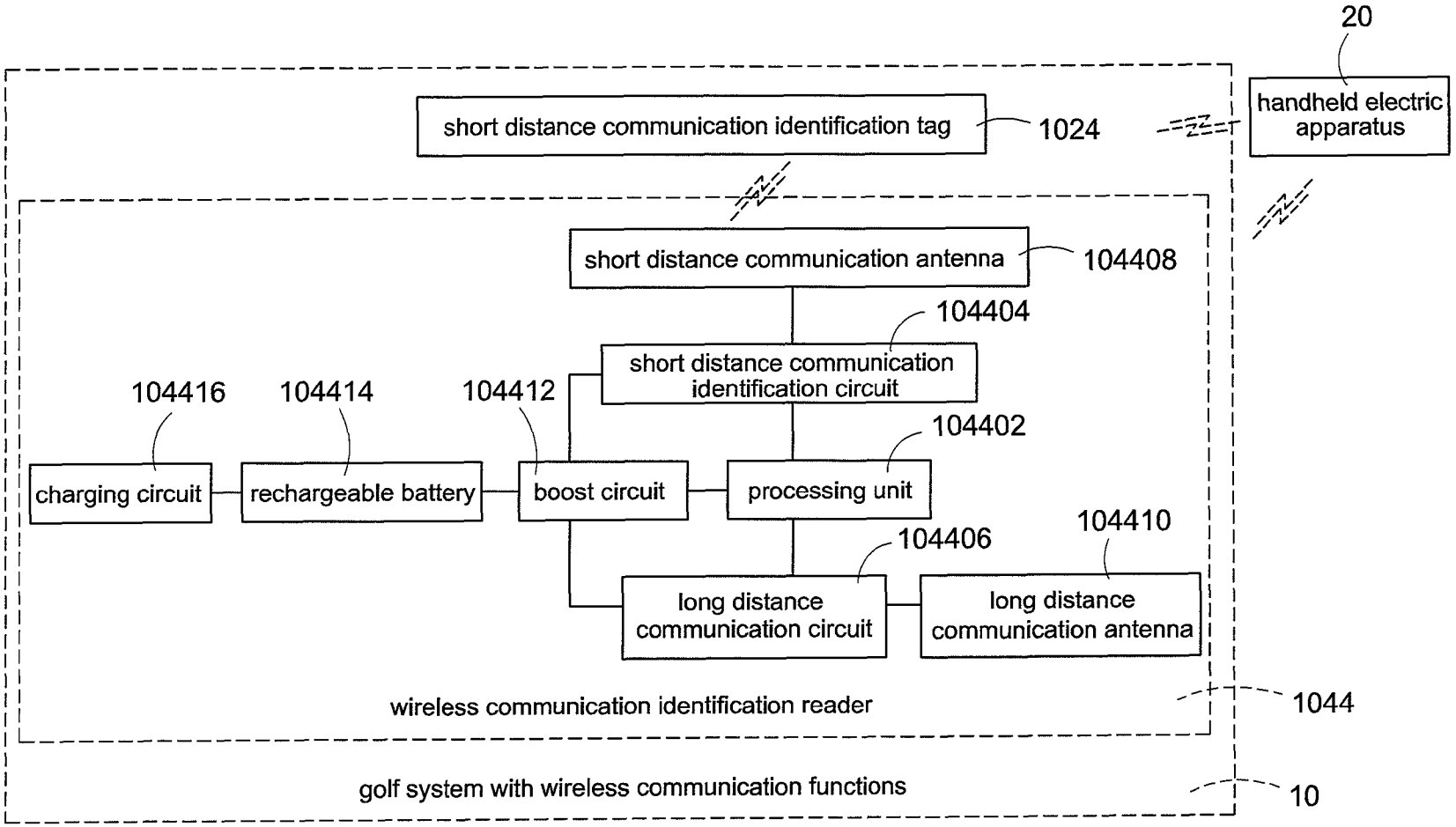
FIG. 2 shows a block diagram of the circuit of the golf system with wireless communication functions of the present invention.

FIG. 2 shows a block diagram of the circuit of the golf system with wireless communication functions of the present invention. The wireless communication identification reader 1044 includes a processing unit 104402, a short distance communication identification circuit 104404, a long distance communication circuit 104406, a short distance communication antenna 104408, a long distance communication antenna 104410, a boost circuit 104412, a rechargeable battery 104414 and a charging circuit 104416.

The short distance communication identification circuit 104404 is electrically connected to the processing unit 104402. The long distance communication circuit 104406 is electrically connected to the processing unit 104402. The short distance communication antenna 104408 is electrically connected to the short distance communication identification circuit 104404. The short distance communication antenna 104408 is wirelessly electrically connected to the short distance communication identification tag 1024. The long distance communication antenna 104410 is electrically connected to the long distance communication circuit 104406. The long distance communication antenna 104410 is wirelessly electrically connected to the handheld electric apparatus 20. The boost circuit 104412 is electrically connected to the processing unit 104402, the short distance communication identification circuit 104404 and the long distance communication circuit 104406. The rechargeable battery 104414 is electrically connected to the boost circuit 104412. The charging circuit 104416 is electrically connected to the rechargeable battery 104414.

In an embodiment, the short distance communication identification tag 1024 is arranged in an inside of a handgrip of the golf club 1022.

In another embodiment, the golf club apparatus 102 further includes a ball marker 1026 (as shown in FIG. 1). The ball marker 1026 is arranged at a bottom of the handgrip of the golf club 1022. The short distance communication identification tag 1024 is arranged in an inside of the ball marker 1026.

Moreover, the wireless communication identification reader 1044 is attached to a bottom of the golf bag 1042 or around the golf bag 1042.

The short distance communication identification tag 1024 is, for example but not limited to, a radio frequency identification tag or a near field communication tag. The short distance communication identification circuit 104404 is, for example but not limited to, a radio frequency identification communication circuit or a near field communication circuit. The long distance communication circuit 104406 is, for example but not limited to, a wireless fidelity (Wi-Fi) communication circuit or a Bluetooth communication circuit.

The handheld electric apparatus 20 is, for example but not limited to, a smart phone. The handheld electric apparatus 20 includes radio frequency identification function or near field communication function to communicate with the short distance communication identification tag 1024 directly.

The advantage of the present invention is to apply Wi-Fi, Bluetooth, RFID and NFC to a golf club and a golf bag for identification.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A golf system with wireless communication functions, the golf system applied to a handheld electric apparatus, the golf system comprising:

at least a golf club apparatus; and a golf bag apparatus, wherein the golf club apparatus comprises:

a golf club; and a short distance communication identification tag attached to the golf club, wherein the golf bag apparatus comprises:

a golf bag; and a wireless communication identification reader attached to the golf bag, wherein the wireless communication identification reader is configured to identify the short distance communication identification tag wirelessly, and then inform the handheld electric apparatus wirelessly;

wherein the wireless communication identification reader comprises a processing unit;

wherein the wireless communication identification reader further comprises a short distance communication identification circuit electrically connected to the processing unit;

wherein the wireless communication identification reader further comprises a long distance communication circuit electrically connected to the processing unit;

wherein the wireless communication identification reader further comprises a short distance communication antenna electrically connected to the short distance communication identification circuit and wirelessly electrically connected to the short distance communication identification tag;

wherein the wireless communication identification reader further comprises a long distance communication antenna electrically connected to the long distance communication circuit and wirelessly electrically connected to the handheld electric apparatus; and wherein the wireless communication identification reader further comprises:

a boost circuit electrically connected to the processing unit, the short distance communication identification circuit and the long distance communication circuit;

a rechargeable battery electrically connected to the boost circuit; and a charging circuit electrically connected to the rechargeable battery.

2. The golf system in claim 1, wherein the golf club apparatus further comprises a ball marker arranged at a bottom of a handgrip of the golf club; the short distance communication identification tag is arranged in an inside of the ball marker.

3. The golf system in claim 2, wherein the wireless communication identification reader is attached to a bottom of the golf bag.

4. The golf system in claim 3, wherein the short distance communication identification tag is a radio frequency identification tag or a near field communication tag; the short distance communication identification circuit is a radio frequency identification communication circuit or a near field communication circuit; the long distance communication circuit is a wireless fidelity communication circuit or a bluetooth communication circuit.

* * * * *